US006113427A

United States Patent [19]

Wu

[11] Patent Number: 6,113,427

[45] Date of Patent: Sep. 5, 2000

[54] ELECTRICAL CONNECTOR HAVING IMPROVED SHIELDING STRUCTURE

[75] Inventor: Kun-Tsan Wu, Tu-Chen, Taiwan

[73] Assignee: Hon Hai Precision Ind. Co., Ltd., Taipei Hsien, Taiwan

[21] Appl. No.: 09/293,589

[22] Filed: Apr. 16, 1999

[30] Foreign Application Priority Data

Oct. 30, 1998 [TW] Taiwan ..... 87217993

[51] Int. Cl.[7] ..... H01R 13/648

[52] U.S. Cl. ..... 439/607

[58] Field of Search ..... 439/607, 609, 439/610, 660

[56] References Cited

U.S. PATENT DOCUMENTS 6,007,379 12/1999 Michaelis ..... 439/607

*Primary Examiner*—Lincoln Donovan
*Assistant Examiner*—Javaid Nasri
*Attorney, Agent, or Firm*—Wei Te Chung

[57] ABSTRACT

An electrical connector includes a nonconductive casing defining a cavity therein having an opening on a front face of the casing for receiving a mating connector. A terminal support post is arranged in the cavity. The post has a plurality of channels defined therein for receiving conductive members that are engageable with counterpart conductive terminals of the mating connector. A shielding member is fit over and surrounds the casing. The shielding member has conductive legs extending therefrom for grounding purposes. Two spring plates extend from the shielding member into the cavity for physically engaging with a conductive shell of the mating connector to mechanically retain the mating connector in the cavity and electrically ground the shell of the mating connector. The electrical connector further includes two additional retaining plates. Each retaining plate has a base section interposed between the casing and the shielding member and electrically connected with the shielding member. The retaining plate has an engaging section resiliently supported on the base section by an arcuate section which biases the engaging section against the conductive shell of the mating connector for securely retaining the mating connector in the cavity and electrically grounding the shell of the mating connector.

12 Claims, 3 Drawing Sheets

ELECTRICAL CONNECTOR HAVING IMPROVED SHIELDING STRUCTURE

BACKGROUND OF THE INVENTION

1. Field of the Invention

The present invention relates to an electrical connector, and in particular to an electrical connector comprising additional retaining plates which enhance the shielding capability of the connector and securely retain a mating connector in the connector.

2. The Prior Art

Electrical connectors are engaged in pairs to connect two electrical devices together. In order to provide proper signal transmission between the electrical devices, the electrical connectors must have a stable mechanical engagement therebetween and be capable of providing adequate electrical shielding to overcome problems of electromagnetic interference. Examples of related connectors are disclosed in Taiwan patent application Nos. 85216824, 85102758 and 85210939.

Such electrical connectors comprise a nonconductive casing defining a cavity therein. A support member is arranged in the cavity to support conductive terminals thereon. A shielding shell is fit over and surrounds the casing. The shielding shell has a front open end for insertion of a mating connector into the cavity. A plurality of spring plates extend from the shell into the cavity and are engageable with a conductive shell of the mating connector for electrically grounding and mechanically retaining the mating connector.

However, such a structure does not provide sufficient shielding for the connector and is incapable of adequately eliminating noise interference. Thus, stability and reliability of signal transmission cannot be ensured. Furthermore, such spring plates do not provide a sufficient mechanical force to effectively retain the mating connector inside the connector. Thus, the mating connector may be detached from the connector when acted upon by a significant external force.

It is thus desirable to have an electrical connector that has an electrically and mechanically stable structure so as to overcome the problems associated with the conventional connector.

SUMMARY OF THE INVENTION

Accordingly, an object of the present invention is to provide an electrical connector having excellent electrical shielding capabilities for providing electrical stability and reliability during signal transmission.

Another object of the present invention is to provide an electrical connector having enhanced mechanical stability when mating with a counterpart connector.

To achieve the above objects, an electrical connector in accordance with the present invention comprises a nonconductive casing defining a cavity therein having an opening on a front face of the casing for receiving a mating connector. A terminal support post is arranged in the cavity. The post has a plurality of channels defined therein for receiving conductive members that are engageable with counterpart conductive terminals of the mating connector. A shielding member is fit over and surrounds the casing. The shielding member has conductive legs extending therefrom for grounding purposes. Two spring plates extend from the shielding member into the cavity for physically engaging with a conductive shell of the mating connector to mechanically retain the mating connector in the cavity and electrically ground the shell of the mating connector. The electrical connector further includes two additional retaining plates. Each retaining plate has a base section interposed between the casing and the shielding member and electrically connected with the shielding member. The retaining plate has an engaging section resiliently supported on the base section by an arcuate section which biases the engaging section against the conductive shell of the mating connector for securely retaining the mating connector in the cavity and electrically grounding the shell of the mating connector.

BRIEF DESCRIPTION OF THE DRAWINGS

The present invention will be apparent to those skilled in the art by reading the following description of a preferred embodiment thereof, with reference to the accompanying drawings, in which.

DETAILED DESCRIPTION OF THE PREFERRED EMBODIMENT

Figure 1:
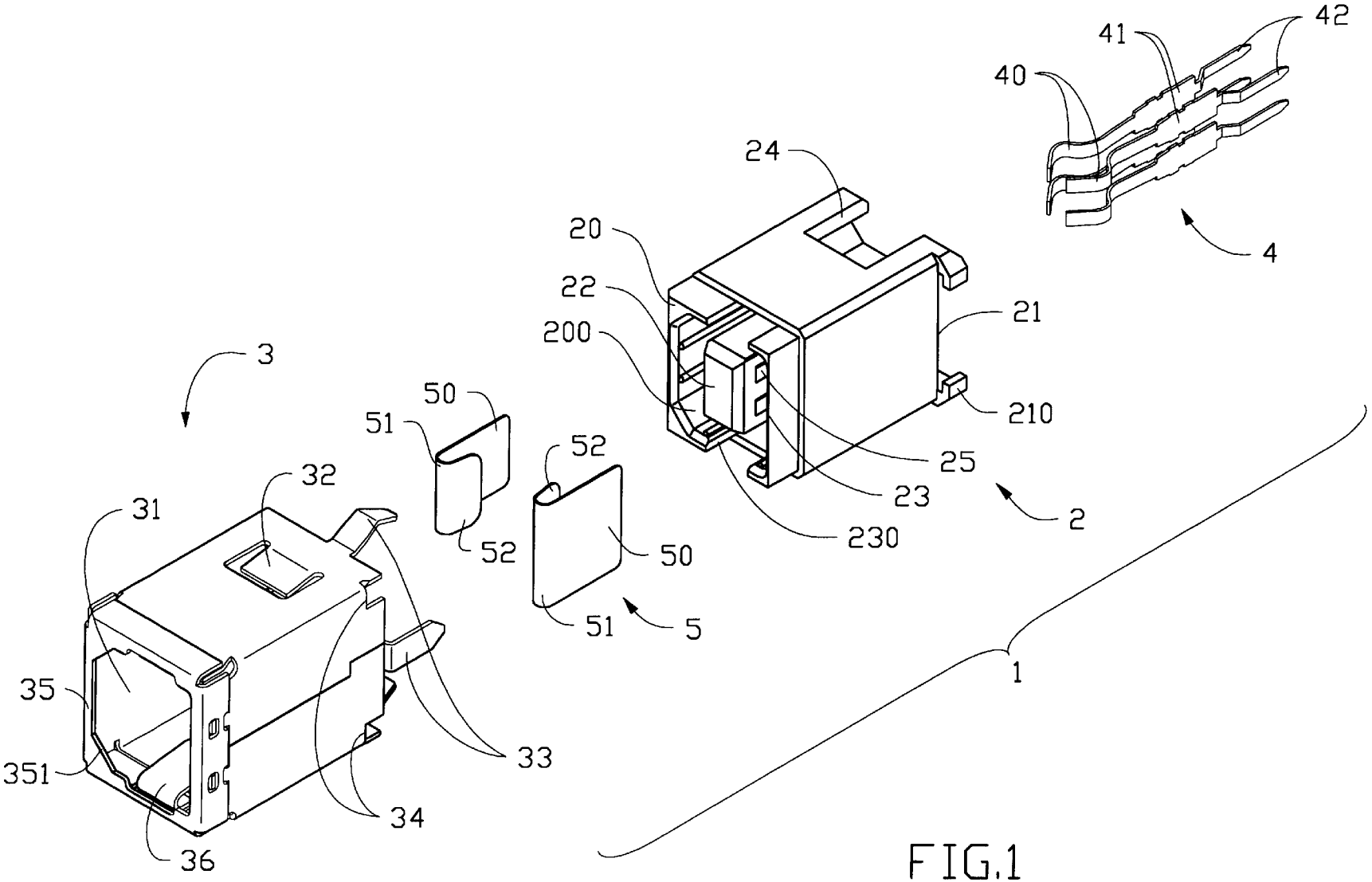
FIG. 1 is an exploded view of an electrical connector in accordance with the present invention.
Figure 2:
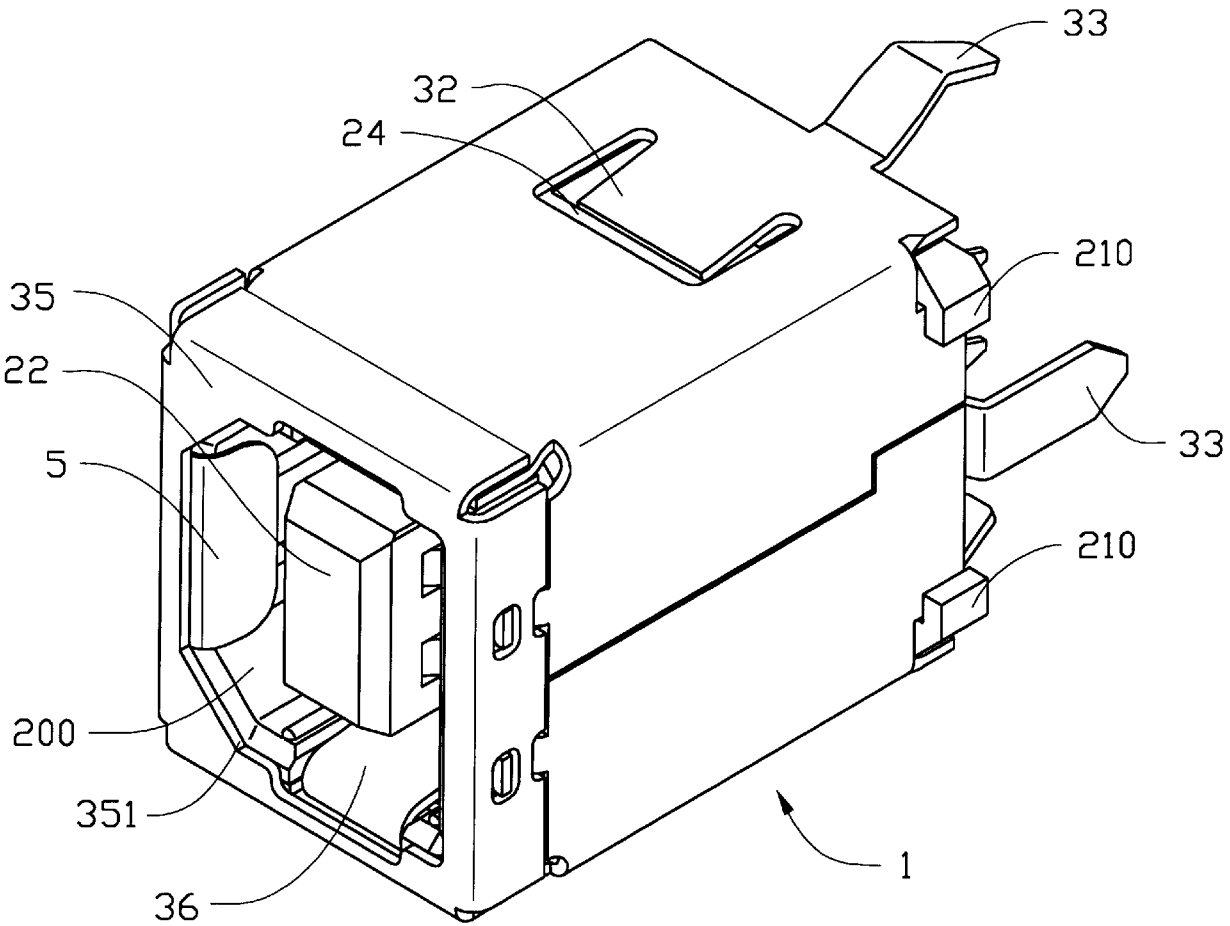
FIG. 2 is an assembled view of FIG. 1.

Referring to the drawings and in particular to FIGS. 1 and 2, wherein an electrical connector constructed in accordance with the present invention, generally designated by the reference numeral 1, is shown, the electrical connector 1 comprises a nonconductive casing 2 retaining a plurality of conductive terminal members 4 therein, a shielding member 3 fit over and surrounding the nonconductive casing 2, and retaining plates 5 made of a resilient, conductive material. The nonconductive casing 2 has a front mating face 20 which mates with a mating connector 100 (FIG. 4) and a rear board mounting face 21 opposite the front face 20. A cavity 200 bound by four side walls is defined in the nonconductive casing 2 and has a predetermined depth from the front face 20 toward the rear face 21 for receiving the mating connector 100. A terminal support post 22 is arranged in the cavity 200 and defines a spacing with each of the side walls of the cavity 200. The support post 22 forms a plurality of terminal receiving channels 25 for accommodating the terminal members 4.

The cavity 200 has an opening 23 on the front face 20 which exposes the terminal support post 22. A notch 230 is defined on each of two opposite side walls of the cavity 200 and is exposed to an edge that bounds the opening 23. The notches 230 receive spring plates 36 of the shielding member 3 which will be further described in detail.

The nonconductive casing 2 comprises two L-shaped projections 210 opposite each other for positioning the casing 2 with respect to the shielding member 3 which will be further described in detail. The nonconductive casing 2 also forms notches 24 thereon for engaging with inward barbs 32 formed on the shielding member 3 for securing the casing 2 in the shielding member 3.

The conductive terminal members 4 are received in the terminal receiving channels 25. Each conductive terminal member 4 comprises an anchoring section 40 which is tightly fit into and thus securely retained by the respective terminal receiving channel 25. Each conductive terminal member 4 also has a mating section 41 which is engageable with a counterpart terminal member 101 of the mating connector 100 (FIG. 4) and a tail section 42 which extends beyond the rear face 21 of the casing 2 for electrically engaging with a circuit board (not shown) to which the connector 1 is mounted.

The shielding member 3 is fit over the nonconductive casing 2 and surrounds the side walls thereof. The shielding member 3 has a front opening 31 and a rear opening (not labeled) corresponding to the opening 23 of the front face 20 and the rear face 21 of the casing 2 for exposing the cavity 200 and the rear face 21.

The shielding member 3 has inward barbs 32 formed thereon for engaging the notches 24 of the casing 2 thereby securing the shielding member 3 and the casing 2 together. Cutouts 34 are formed on the shielding member 3 for engaging with the projections 210 of the casing 2. A plurality of legs 33 extend from the shielding member 3 beyond the rear face 21 of the casing 2 for being solderably mounted to the circuit board.

The shielding member 3 comprises a front cap 35 fit over the front opening 31 thereof. The front cap 35 has an opening 351 corresponding to the front opening 31 of the shielding member 3 and dimensioned to receive the mating connector 100 therein. The cap 35 comprises two spring plates 36 fixed thereon and extending therefrom into the cavity 200. The spring plates 36 are partially received in the notches 230 of the cavity 200 of the casing 2. The spring plates 36 are dimensioned to engage a conductive shell 102 of the mating connector 100 for establishing electrical connection therebetween. Thus, the conductive shell 102 of the mating connector 100 is grounded.

Figure 4:
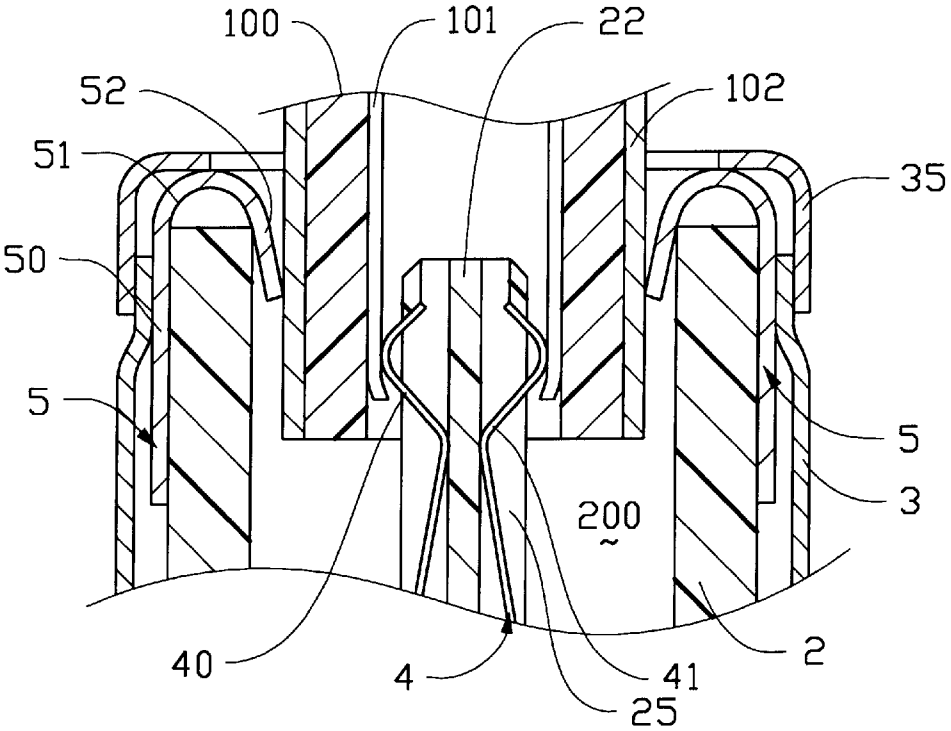
FIG. 4 is a cross-sectional view of a portion of the electrical connector of the present invention showing a mating connector engaged therewith.
Figure 3:
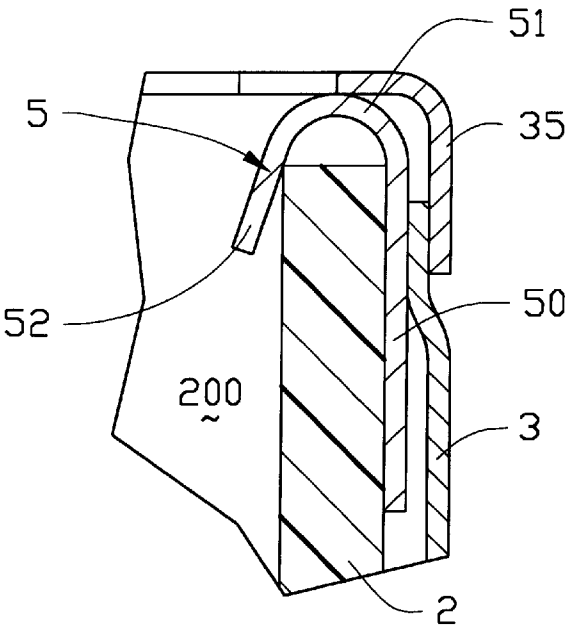
FIG. 3 is a cross-sectional view of a portion of the electrical connector of the present invention.

Also referring to FIGS. 3 and 4, each retaining plate 5 has a base section 50 interposed between one of the side walls of the casing 2 and the shielding member 3 for securely fixing the retaining plate 5 to and establishing electrical engagement with the shielding member 3 for grounding purposes. The retaining plate 5 has an engaging section 52 extending into the cavity 200 and engageable by the conductive shell 102 of the mating connector 100. In the embodiment illustrated, an arcuate section 51 is connected between the base section 50 and the engaging section 52 to provide the engaging section 52 with a biasing force and resilient support.

The biasing force acting upon the engaging section 52 provides a secure engagement of the engaging section 52 with the shell 102 of the mating connector 100 thereby more securely retaining the mating connector 100 in the cavity 200 of the casing 2. Furthermore, the conductive shell 102 of the mating connector 100 is provided with an additional grounding path.

In the embodiment illustrated, the retaining plates 5 are arranged on the two side walls of the casing 2 which does not have a spring plate 36 associated therewith. Thus, the mating connector 100 is provided with excellent shielding by both the resilient retaining plates 5 and the spring plates 36 of the connector. The mating connector 100 is also securely retained in the cavity 200 by means of the resilient retaining plates 5 and the spring plates 36.

Although the present invention has been described with reference to a preferred embodiment thereof, it is apparent to those skilled in the art that there are a variety of modifications and changes that may be made without departing from the scope of the present invention which is intended to be defined by the appended claims.

What is claimed is:

1. An electrical connector comprising:

a non-conductive casing having a front face and a rear face opposite the front face, a cavity defined in the casing through the front face and adapted to receive an external mating connector therein, a plurality of terminal receiving channels further defined in the cavity;

conductive terminals received and retained in the terminal receiving channels, the terminals having a first end electrically engageable with counterpart terminals of the mating connector and a second end extending beyond the rear face of the casing and adapted to electrically engage with an external substrate;

a shielding member fit over and surrounding the casing, the shielding member having an opening corresponding to the cavity defined in the front face of the casing, the shielding member comprising two spring plates extending into the cavity and adapted to be physically engageable with a conductive shell of the mating connector for providing an electrical connection with and applying a mechanical retaining force on the shell of the mating connector; and additional retaining means removably fixed to the shielding member and having an engaging section extending into the cavity to physically engage with the conductive shell of the mating connector.

2. The electrical connector as claimed in claim 1, wherein the cavity is bound by four side walls, the spring plates being received in the cavity adjacent to and parallel to two opposite side walls, each spring plate having a section extending into the cavity and resiliently engageable with the mating connector.

3. The electrical connector as claimed in claim 1, wherein the additional retaining means is arranged between the shielding member and the casing with the engaging section extending therefrom into the cavity.

4. The electrical connector as claimed in claim 3, wherein the additional retaining means comprises an elongate plate made of resilient material interposed between the casing and the shielding member at two opposite side walls of the casing.

5. The electrical connector as claimed in claim 4, wherein the elongate plate of the additional retaining means comprises a base section interposed between the casing and the shielding member, the engaging section of the additional retaining means being resiliently supported on the base section and extending into the cavity to be biased against the mating connector.

6. The electrical connector as claimed in claim 5, wherein the elongate plate of the additional retaining means comprises an arcuate section connecting the engaging section to the base section and resiliently biasing the engaging section against the mating connector to electrically engage with the conductive shell of the mating connector.

7. The electrical connector as claimed in claim 1, wherein the casing comprises a terminal support post located in the cavity, the terminal receiving channels being formed in the terminal support post.

8. The electrical connector as claimed in claim 1, wherein the casing forms projections thereon and the shielding member defines cutouts therein for receivingly engaging the projections.

9. The electrical connector as claimed in claim 1, wherein the casing forms notches thereon and wherein the shielding member comprises inward barbs engageable with the notches to secure the shielding member to the casing.

10. The electrical connector as claimed in claim 1, wherein the shielding member comprises a cap fit over the opening of the shielding member, the cap defining a hole corresponding to the opening of the shielding member, the hole being dimensioned to receive the mating connector therein.

11. The electrical connector as claimed in claim 1, wherein the shielding member comprises conductive legs extending therefrom beyond the rear face of the casing for mounting to the external substrate.

12. An electrical connector comprising:

a non-conductive casing defining opposite front and rear faces with a cavity extending through the front face;

a plurality of conductive terminals positioned within the casing;

a shielding member surrounding the casing and defining an opening in alignment with the cavity, said shielding member further integrally forming a pair of spring plates extending into the cavity for retaining a mating connector in the cavity; and additional retaining means being separated from the shielding member, said retaining means including a first section sandwiched between the shielding member and the casing, and a second section extending into the cavity around the opening; wherein the spring plates provides retention in a first direction and the additional retaining means provides retention in a second direction perpendicular to said first direction.

* * * * *